US006823792B2

(12) United States Patent
Grützmacher et al.

(10) Patent No.: US 6,823,792 B2
(45) Date of Patent: Nov. 30, 2004

(54) MULTI-MOTOR DRIVE AND METHOD FOR DRIVING A PRINTING PRESS

(75) Inventors: Bertold Grützmacher, Schriesheim (DE); Stefan Maier, Heidelberg (DE); Matthias Nöll, Weiterstadt (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/206,308

(22) Filed: Jul. 26, 2002

(65) Prior Publication Data

US 2003/0019375 A1 Jan. 30, 2003

(30) Foreign Application Priority Data

Jul. 26, 2001 (DE) ..... 101 36 126
Mar. 21, 2002 (DE) ..... 102 12 534

(51) Int. Cl.[7] ..... B41F 31/00; B41F 5/16

(52) U.S. Cl. ..... 101/483; 101/212; 101/216; 101/248; 101/181; 101/183

(58) Field of Search ..... 101/216, 219, 101/136–143, 181, 183, 483–485, 211, 248

(56) References Cited

U.S. PATENT DOCUMENTS

| | | | | | |
|---|---|---|---|---|---|
| 3,452,261 | A | * | 6/1969 | Tagliasacchi | 101/181 |
| 3,557,692 | A | * | 1/1971 | Lee | 101/183 |
| 4,458,893 | A | * | 7/1984 | Ruh | 101/248 |
| 5,036,764 | A | * | 8/1991 | Rodi | 101/181 |
| 5,117,753 | A | * | 6/1992 | Mamberer | 101/181 |
| 5,136,943 | A | * | 8/1992 | Fischer et al. | 101/183 |
| 5,365,841 | A | * | 11/1994 | Uhrig | 101/181 |
| 5,377,585 | A | * | 1/1995 | Kipphan | 101/181 |
| 5,377,589 | A | * | 1/1995 | Krüger et al. | 101/248 |
| 5,398,603 | A | * | 3/1995 | Hartmann et al. | 101/183 |
| 5,481,971 | A | * | 1/1996 | Grützmacher et al. | 101/183 |
| 5,720,222 | A | | 2/1998 | Reichardt et al. | |
| 5,787,806 | A | * | 8/1998 | Seyfried | 101/181 |
| 5,826,505 | A | * | 10/1998 | Völz et al. | 101/183 |
| 5,894,802 | A | * | 4/1999 | Jackson | 101/485 |
| 5,901,647 | A | * | 5/1999 | Kohlmann | 101/216 |
| 5,924,362 | A | * | 7/1999 | Völz et al. | 101/183 |
| 5,927,195 | A | * | 7/1999 | Völz et al. | 101/183 |
| 5,983,793 | A | * | 11/1999 | Völz et al. | 101/216 |
| 5,988,063 | A | * | 11/1999 | Brandenburg et al. | 101/219 |
| 6,095,043 | A | | 8/2000 | Hartmann et al. | |
| 6,109,176 | A | * | 8/2000 | Fujio et al. | 101/216 |
| 6,327,976 | B1 | * | 12/2001 | Stiel | 101/248 |
| 6,349,642 | B1 | * | 2/2002 | Olomski et al. | 101/183 |
| 6,427,590 | B1 | * | 8/2002 | Rössler et al. | 101/181 |
| 6,446,553 | B1 | * | 9/2002 | Costin et al. | 101/183 |
| 2001/0013292 | A1 | * | 8/2001 | Faulhammer et al. | 101/248 |
| 2002/0023560 | A1 | * | 2/2002 | Siegl et al. | 101/248 |

FOREIGN PATENT DOCUMENTS

| | | |
|---|---|---|
| DE | 33 09 020 A1 | 12/1983 |
| DE | 195 12 865 C2 | 10/1996 |
| DE | 195 25 593 A1 | 1/1997 |
| DE | 196 50 075 A1 | 6/1998 |
| DE | 197 42 461 A1 | 4/1999 |
| DE | 198 20 315 A1 | 4/1999 |
| DE | 199 03 869 A1 | 8/2000 |

* cited by examiner

*Primary Examiner*—Eugene H. Eickholt
(74) *Attorney, Agent, or Firm*—Laurence A. Greenberg; Werner H. Stemer; Ralph E. Locher

(57) ABSTRACT

A multi-motor drive for a printing press having a plurality of printing unit groups, includes at least one motor provided for each of the printing unit groups, and gear trains via which the printing unit groups are synchronously driven. The gear trains are mechanically separated from one another during a printing operation. The at least one motor is assigned to a respective separation location between the printing unit groups. A method for driving a printing press is also provided.

16 Claims, 11 Drawing Sheets

MULTI-MOTOR DRIVE AND METHOD FOR DRIVING A PRINTING PRESS

BACKGROUND OF THE INVENTION

Field of the Invention

The invention relates to a multi-motor drive and a method for driving a printing press.

In the drive of a printing press having a plurality of motors, the motors must be synchronized so that no disruptive register fluctuations occur in the printed image. Register fluctuations are produced due to rotational oscillations in the cylinders used for printing and due to tooth-flank changes in the gear train of the drive. Rotational oscillations at a frequency that is not an integer multiple of the printing cycle are produced, for example, when more gripper bars than one gripper bar are installed on a cylinder for conveying sheets or when reciprocable inking rollers are installed. Flank changes in a gear train occur when the torque flow direction changes in at least one gear. Flank changes occur randomly and are not predictable.

In the case of presses with a large number of printing units, it has become known heretofore, for example, from German Published, Non-prosecuted Patent Application DE 195 12 865 A1, to divide a printing press into partial presses, each partial press having its own drive motor assigned thereto. For sheet-fed rotary printing presses convertible for operation between single side and first form and perfecter printing, the division or separation location may be upstream of a reversing or turning drum of a perfecting device. The division into partial presses results in drive groups with high mechanical eigenfrequencies, i.e., natural or characteristic frequencies, due to which disruptive oscillations may be reduced if the drive gears and cylinders are positioned precisely on both sides of a separation or division location.

In the case wherein exactly one motor per partial press is installed, a partial press behaves in a manner similar to that of a single driven printing press. The rotational oscillations within a partial press cannot be compensated for satisfactorily. Due to the high mass moments of inertia of the partial presses, the synchronization at the locations of separation or division is also impaired.

German published, Non-prosecuted Patent Application DE 195 25 593 A1, corresponding to U.S. Pat. No. 5,720,222, discloses a multi-motor drive for a printing press wherein a under or a printing unit has two drive motors, respectively, assigned thereto, the printing units being decoupled mechanically from one another. With a first one of the drive motors, a basic torque is infed, while the second drive motor is a highly dynamic drive, with which the remainder of the torque, implementing the synchronism of the cylinders or printing units, is infed. A printing press having ten printing units thus has twenty drive motors, the synchronization of which is consequently quite problematical.

In a device for driving printing presses with a plurality of motors arranged decoupled, as is disclosed in German Published, Non-prosecuted Patent Application DE 197 42 461 A1, corresponding to U.S. Pat. No. 6,095,043, a transfer station with a separately controllable drive is provided between two mechanically decoupled printing unit groups. A phase offset between the printing unit groups can be compensated for by controlling the transfer station. The transfer station constitutes only a low mass, which can be managed well by appropriate control technology.

SUMMARY OF THE INVENTION

It is accordingly an object of the invention to provide a drive and a method for driving a printing press which, with little expenditure of material and low cost, rapidly and accurately permits production and maintenance of synchronism between printing unit groups.

With the foregoing and other objects in view, there is provided, in accordance with one aspect of the invention, a multi-motor drive for a printing press having a plurality of printing unit groups, comprising at least one motor provided for each of the printing unit groups, and gear trains via which the printing unit groups are synchronously driven, the gear trains, during a printing operation, being mechanically separated from one another, the at least one motor being assigned to a respective separation location between the printing unit groups.

In accordance with another feature of the invention, in addition to a main motor feeding into a respective gear train of a printing unit group, two auxiliary motors are provided for the respective separation location.

In accordance with a further feature of the invention, in addition to a main motor feeding into a respective gear train of a printing unit group, one auxiliary motor only is provided for the respective separation location.

In accordance with an added feature of the invention, in addition to a main motor feeding into a respective gear train of a printing unit group, an auxiliary motor is provided, in the case of a printing unit group located between two other printing unit groups, the auxiliary motor being assigned to a separation location.

In accordance with an additional feature of the invention, the auxiliary motors have a lower power than the main motors.

In accordance with another aspect of the invention, there is provided a method for driving a printing press, which comprises, for printing with a plurality of motors, at separation locations between gear trains mechanically decoupled from one another, infeeding torques, respectively, into the gear trains.

In accordance with a further mode, the method of the invention further comprises providing at least one main motor and at least one auxiliary motor for driving at least one gear train.

In accordance with an added mode, the method of the invention additionally comprises having the main motor serve for infeeding a torque that drives, on average, and having the auxiliary motor serve for producing a torque that brakes, on average.

In accordance with an additional mode, the method of the invention further comprises applying a constant nominal current value to the auxiliary motor.

In accordance with yet another mode, the method of the invention further comprises controlling the main motor and the auxiliary motor with respect to the rotational angle thereof.

In accordance with yet a further mode, the method of the invention further comprises setting an angular offset between the main motor and the auxiliary motor.

In accordance with yet an added mode, the method of the invention further comprises setting a constant angular offset between the main motor and the auxiliary motor.

In accordance with yet an additional mode, the method of the invention further comprises variably setting by a control system a differential angle between the main motor and the auxiliary motor, so that respective average actual current values of the auxiliary motors maintain a nominal value.

In accordance with still another mode, the method of the invention comprises providing, in a press with a plurality of separation locations, differential angles of nominal values of a closed-loop control of motors from at least one group thereof selected from a group consisting of auxiliary motors and a group consisting of main motors on both sides of the separation location which, relative to a reference press angle, are respectively constant, and determining the differential angle of the nominal value of the closed-loop control of a respective motor at a separation location of a printing unit group by an adjacent printing unit group.

In accordance with still a further mode, the method of the invention comprises providing, in a press with a plurality of separation locations, differential angles of nominal values of a closed-loop control of motors from at least one group thereof selected from a group consisting of auxiliary motors and a group consisting of main motors on both sides of the separation location which, relative to a reference press angle, are respectively constant and close to zero, and determining the differential angle of the nominal value of the closed-loop control of a respective motor at a separation location of a printing unit group by an adjacent printing unit group.

In accordance with a concomitant mode, the method of the invention further comprises performing an interference variable control when driving motors from at least one group of motors respectively selected from a group consisting of main motors and a group consisting of auxiliary motors.

Due to the provision of motors in the drive train of a printing unit group, additional possibilities of intervention result directly at a separation location, in order to prevent flank changes from occurring and to improve the synchronism under controlled operation.

A sheet-fed printing press having a relatively large number of printing units can advantageously be divided into two or more printing unit groups, which are driven mechanically decoupled from one another. A printing unit group includes a partial gear train for driving at least one paper-carrying element, such as a cylinder. Each partial gear train can be driven by a main motor and by one or two auxiliary motors. The number of auxiliary motors depends upon the number of adjacent printing unit groups. The auxiliary motors infeed the torque thereof, respectively, at a separation location between the printing unit groups. It is possible to provide an auxiliary motor for each separation location. The auxiliary motors are acted upon with a constant torque or operated under control, coupled to a measuring device. The main motors continuously introduce a driving torque into the respective partial gear train and are controlled with the aid of the feedback of a measured variable, which is determined by a measuring sensor. Examples of the measured variables are the angular position, the speed and/or the acceleration directly at the motor shaft or at any desired shaft in the respective printing unit group. At all times, the auxiliary motors introduce a braking torque into the printing unit groups.

The auxiliary motors can be operated in different ways. In one possible embodiment, the auxiliary motor is acted upon by a constant desired or nominal current value and supplies a constant torque. In this way, flank changes can reliably be prevented.

In one embodiment, auxiliary motors are coupled to measured value sensors and are operated under control with the aid of a feedback of the measured values. Here, too, both the angular position and the speed and also the acceleration can be measured. The measured value sensors required for this purpose are applied as close as possible to a separation location between the printing unit groups. Ideally, the measured value sensors are arranged on the paper-carrying cylinders immediately adjacent to a separation location. When predefining or prescribing a desired or nominal value for the controlled operation of the auxiliary motors, a differential angle in relation to the desired or nominal value used for the main motors is set, in order to avoid the occurrence of flank changes in the relevant partial gear train. As a result, an offset is achieved in the gear train of the respective printing unit group. The differential angle is set in such a way that the average auxiliary motor current always has a maximum negative value which, when a constant motor current is predefined or prescribed, just avoids flank changes.

Both when acted upon by a constant desired or nominal current value and during controlled operation of an auxiliary motor, interfering variable compensation can additionally be performed. The desired or nominal value for the main motors used under certain circumstances in a modified form for the auxiliary motors under controlled operation can be derived from a virtual line shaft or from a real value measured on a shaft of the printing press.

It is possible for a differential angle between a main motor and an auxiliary motor to be set variably so that the respective average actual current values of the auxiliary motors maintain a desired or nominal value. The sliding average of the auxiliary motor currents can be determined, for example, by filtering the auxiliary-motor desired or nominal current or actual current value.

Other features which are considered as characteristic for the invention are set forth in the appended claims.

Although the invention is illustrated and described herein as embodied in a multi-motor drive and method for driving a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
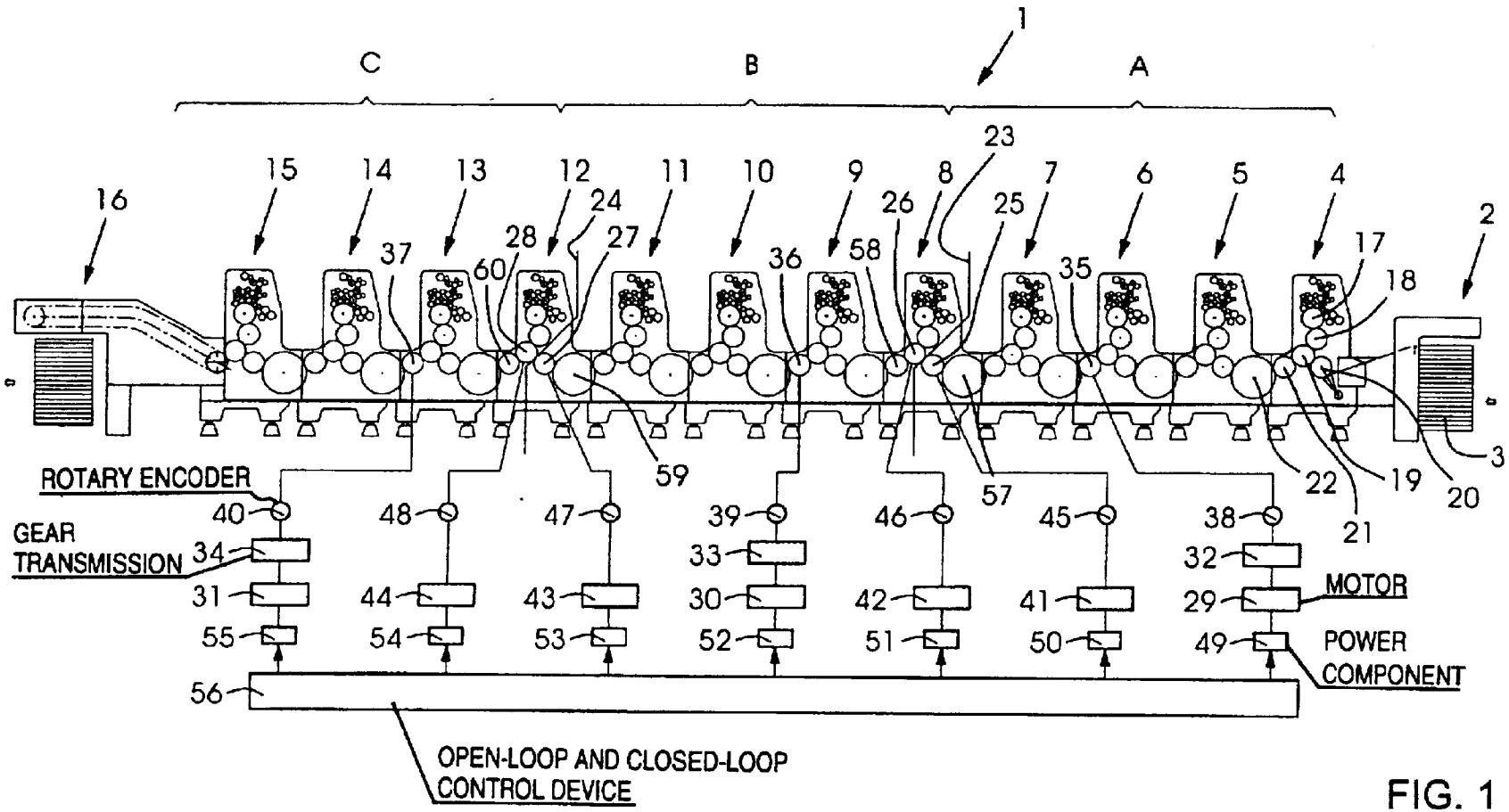
FIG. 1 is a diagrammatic front elevational and schematic view of a printing press with twelve printing units having two auxiliary motors for each separation or disconnecting location.

Referring now to the drawings and, first, particularly to FIG. 1 thereof, there is shown therein a sheet-fed printing press 1 of in-line construction having a feeder 2 for supplying sheets from a sheet pile 3 to a printing unit 4. During conveyance of the sheets from the first printing unit 4 through further printing units 5 to 15, the sheets are printed. The printed sheets ultimately pass into a delivery 16. Each printing unit 4 to 15 has gears 17, 19 for synchronously driving a form cylinder, a transfer cylinder and an impression cylinder and further gears 20 to 22 for driving sheet transport drums. In the drive gear train of the sheet-fed printing press 1, there are separation or disconnection locations 23, 24, which divide the twelve printing units into three printing unit groups A, B and C. At the respective separation location 23, 24, during printing, there is no torque flow via the adjacent gears 25, 26 and 27, 28 of the printing unit groups A, B and B, C, i.e., they are mechanically decoupled from one another. Each printing unit group A, B, C is driven by a main motor 29 to 31. The main motors 29 to 31 are coupled via a gear mechanism 32 to 34 to a respective centrally located gear 35 to 37 in the drive gear train of the respective printing unit group A, B, C. The rotational movement of the gears 35 to 37, respectively, is registered by incremental or absolute rotary encoders 38 to 40, respectively. In the gear train of the printing unit group A, an auxiliary motor 41 acts upon the gear 25 at the separation location 23. In the gear train of the printing unit group B, auxiliary motors 42 and 43 act upon the gears 26 and 27, respectively, at the respective separation locations 23 and 24. In the gear train of the printing unit group C, an auxiliary motor 44 acts upon the gear 28 at the separation location 24. The rotational movement of the auxiliary motors 41 to 44 is registered by incremental or absolute rotary encoders 45 to 48, respectively. In order to supply power to all the main motors 29 to 31 and auxiliary motors 41 to 44, power components 49 to 55 are provided, which are connected to an open-loop and closed-loop control device 56.

The auxiliary motors 41 to 44 feed into gears 25 to 28, which are located directly at the separation locations 23, 24. The action according to the invention will also continue to occur if the auxiliary motors 41 to 44 feed into gears 57 to 60 which are located in the vicinity of the separation locations 23, 24. In addition, gear mechanisms or transmissions can be disposed upstream of the auxiliary motors 41 to 44.

Figure 2:
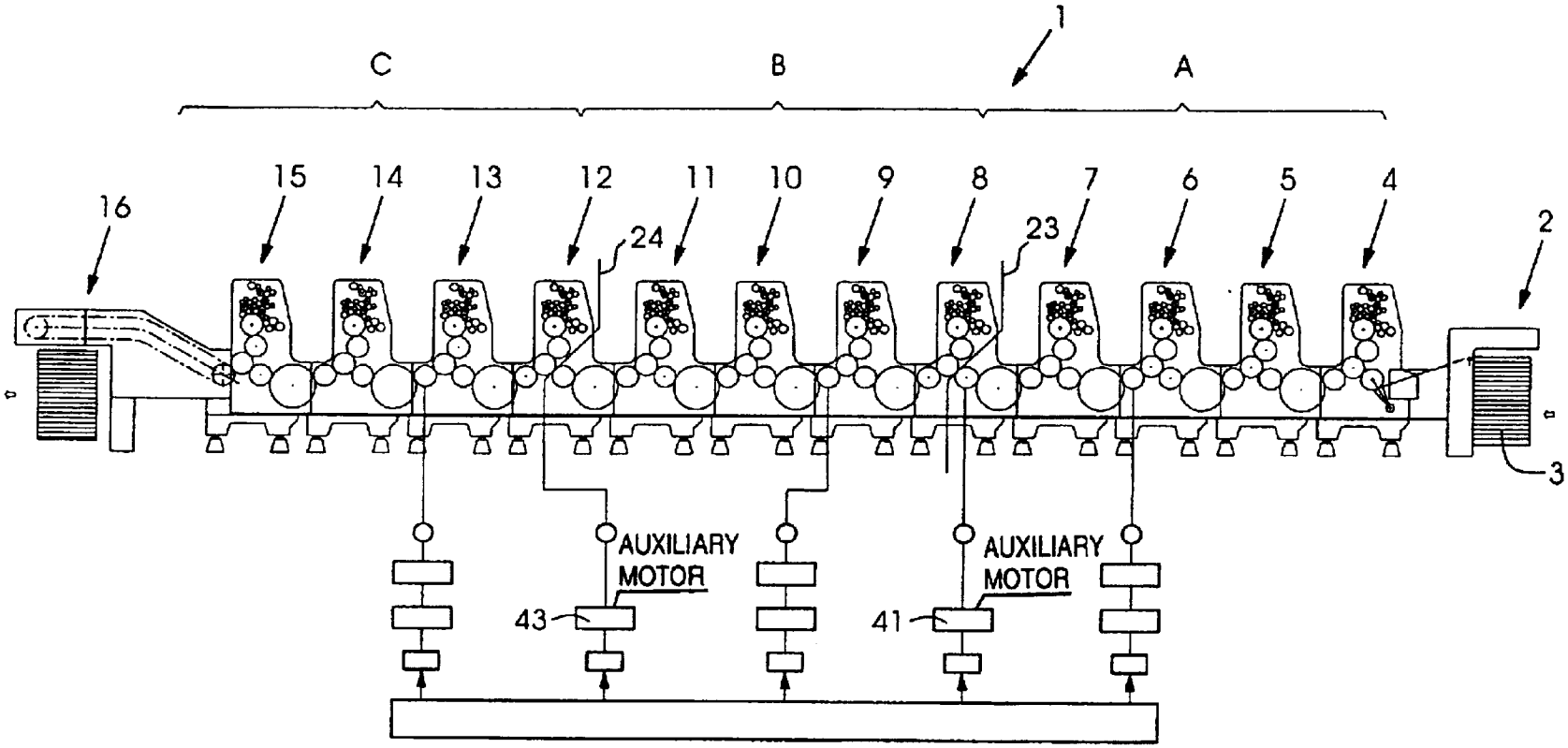
FIG. 2 is a view like that of FIG. 1 of a printing press with twelve printing units having one auxiliary motor for each separation location.
Figure 3:
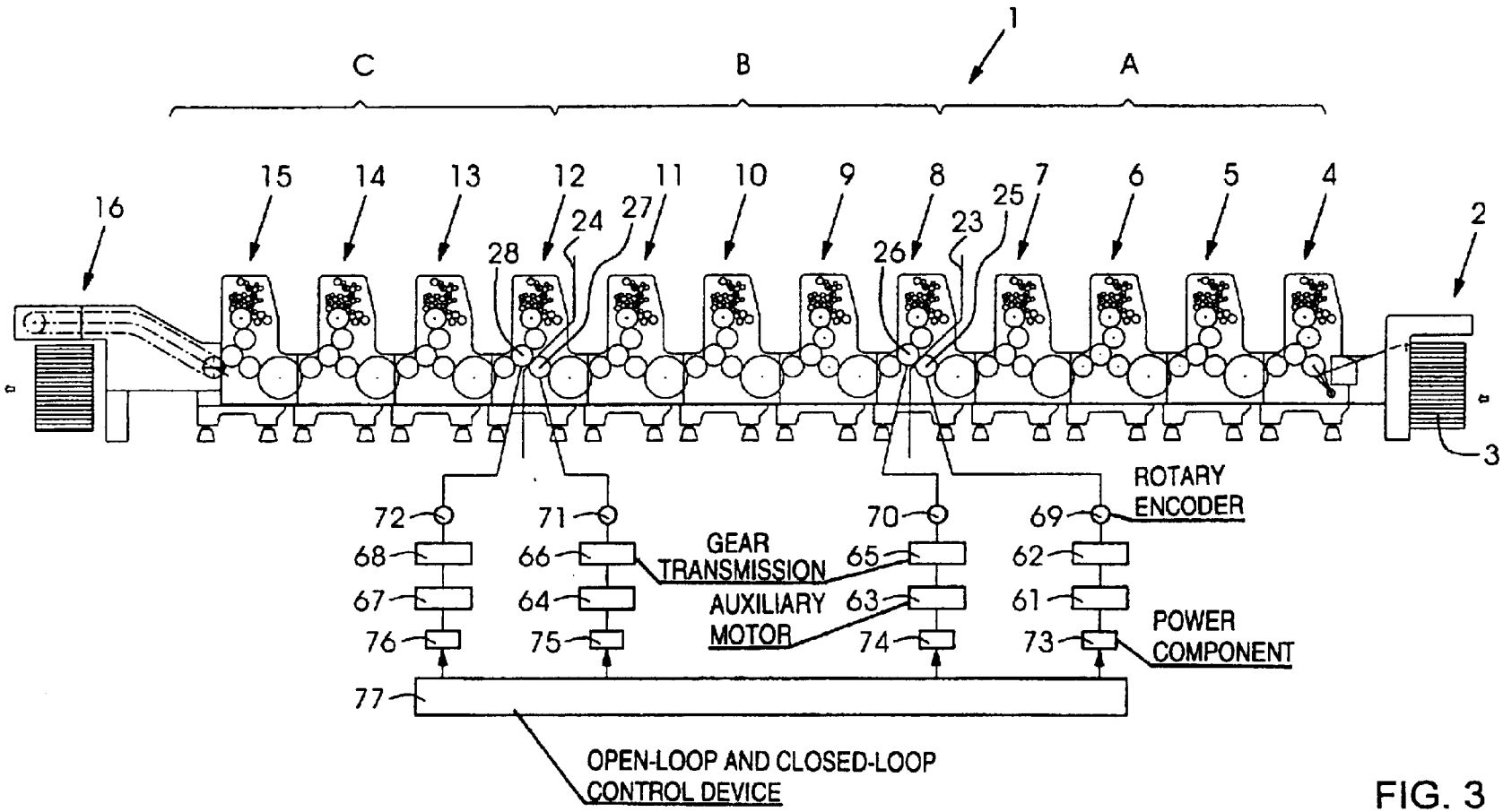
FIG. 3 is a view like those of FIGS. 1 and 2 of a printing press with twelve printing units having one auxiliary motor at a printing unit group lying between two other printing unit groups.

Two further embodiments of multi-motor drives are illustrated in FIGS. 2 and 3, respectively. For elements having equivalent actions or operations, the reference numerals shown in FIG. 1 are maintained in FIGS. 2 and 3.

In the modified embodiment according to FIG. 2, only one auxiliary motor 41, 43 is employed for each separation location 23, 24. Expense is thereby reduced, but the synchronism between the printing unit groups A, B and C is slightly impaired.

In the modified embodiment according to FIG. 3, expense is reduced even further. The printing unit group A is driven by only one main motor 61. The main motor 61 feeds via a gear mechanism 62 to the gear 25, which is located directly at the separation location 23. The gears 27 and 28, respectively, located at the respective separation locations 23 and 24 of the printing unit group B are an auxiliary motor 63 and a main motor 64, respectively, via respective gear mechanisms or transmissions 65 and 66. The printing unit group C, like the printing unit group A, is driven by only one main motor 67. The main motor 67 infeeds the torque thereof via a gear mechanism or transmission 68 to the gear 28, which is located at the separation location 24. The rotational movement of the gears 25 to 28 is registered by rotary encoders 69 to 72, respectively. The main motors 61, 64 and auxiliary motors 63, 67 are connected to power components 73 to 71, which are driven by an open-loop and closed-loop control device 77.

Hereinafter, referring to the control schematics of FIGS. 4 to 9, a description is given of how the sheet-fed printing press 1 can be driven with the open-loop and closed-loop control devices 56 and 77.

Figure 4:
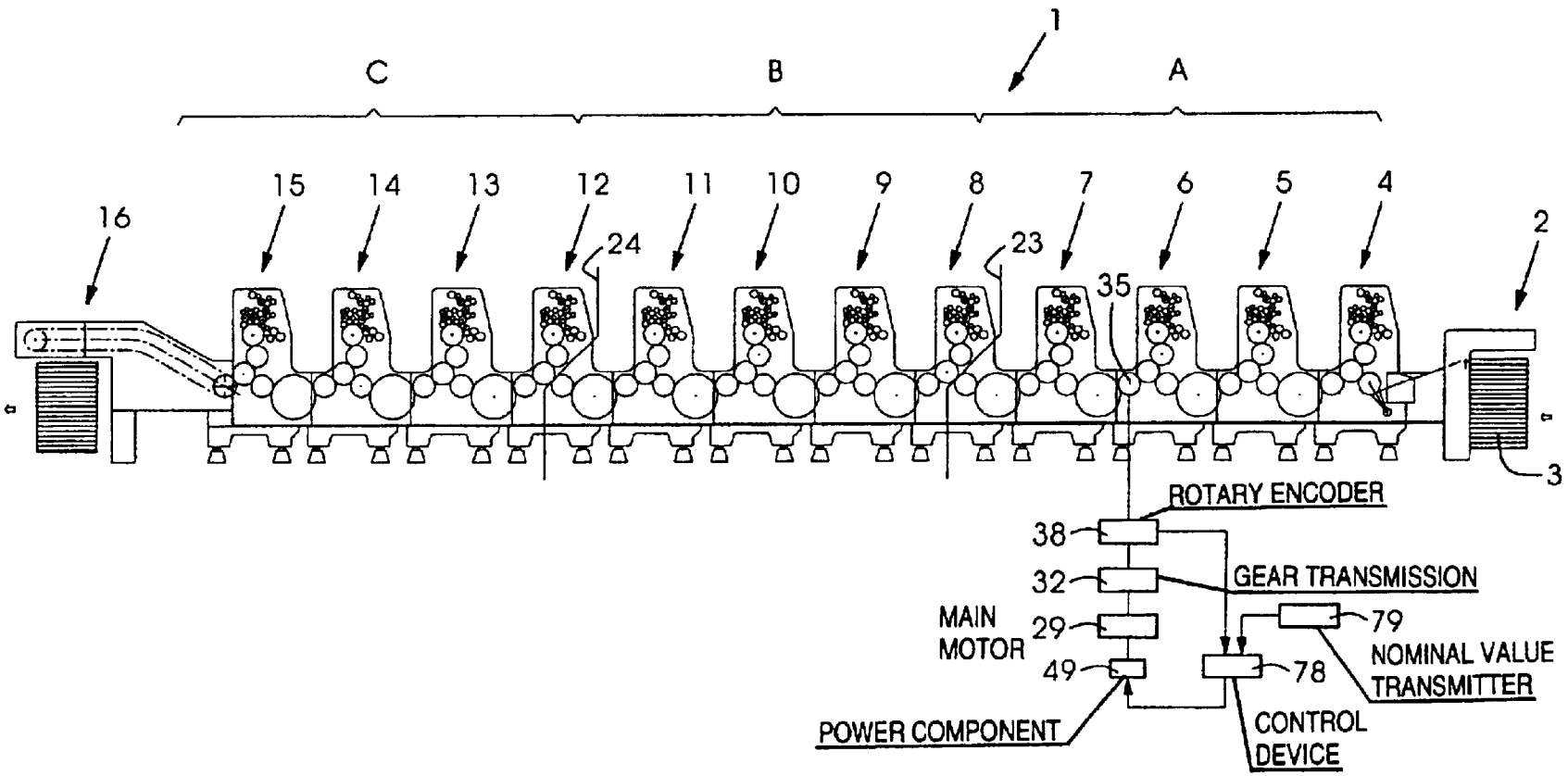
FIG. 4 is a view like that of FIG. 1 showing a control schematic for a printing unit group of a printing press according to FIG. 1.

For the closed-loop control of the main motor 29 shown in FIG. 1, the signal from the rotary encoder 38 is fed to a control device 78, as shown in FIG. 4. The signal from the rotary encoder 38 represents the actual value of the rotational angle of the gear 35 at the center of the printing unit group A. A desired or nominal rotational angle value is fed to the control device 78 by a desired or nominal value transmitter 79. The control device 78 has a nominal or desired value/actual value comparator. The value resulting from the comparison comprising the difference between desired or nominal value and actual value serves for deriving a control variable, which is fed to the power component 49. The effect of the closed-loop control is that the rotational angle of the gear 35 corresponds to the desired or nominal value, except for slight deviations.

Figure 5:
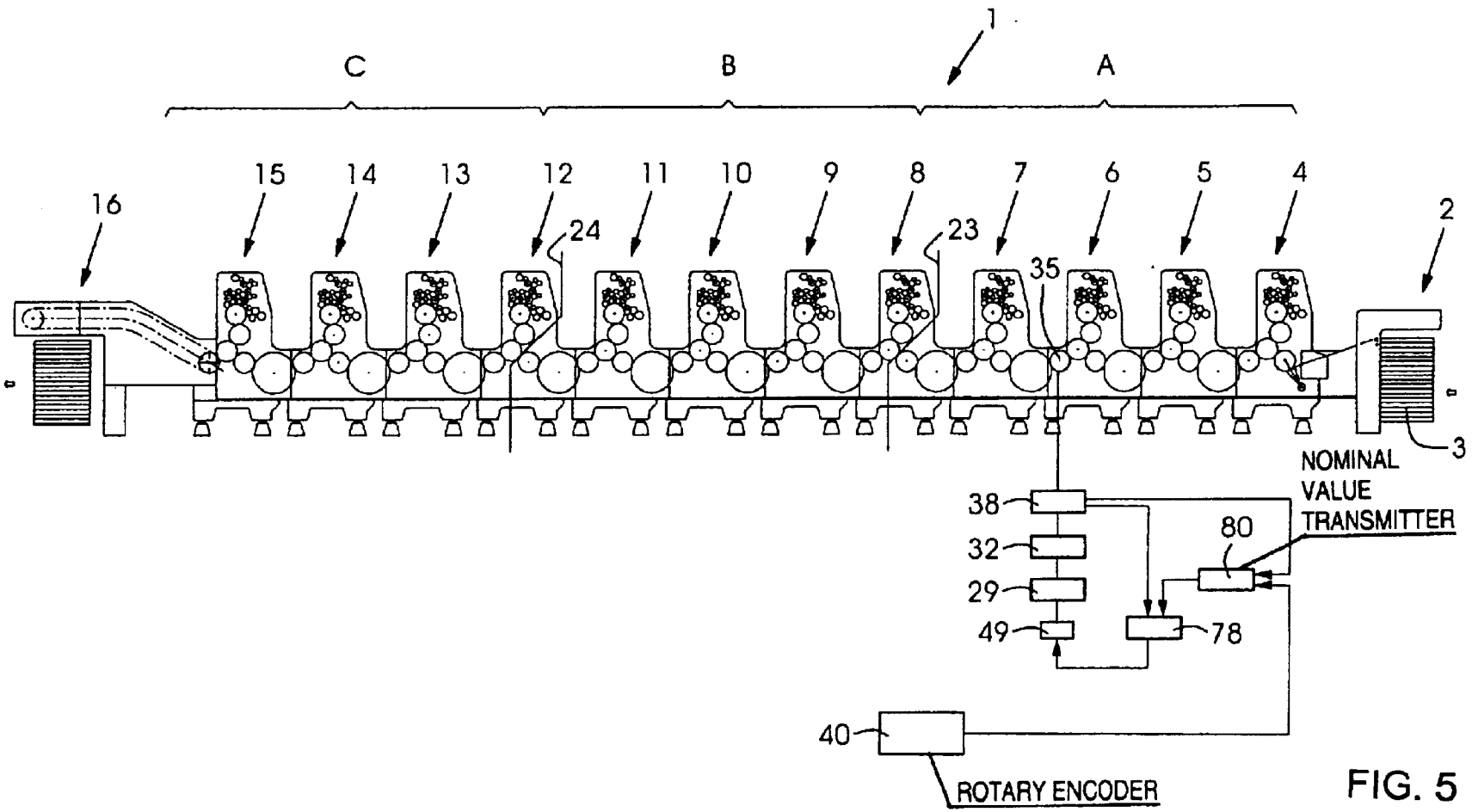
FIG. 5 is a view like that of FIG. 2 showing a control schematic for a printing unit group of a printing press according to FIG. 2.

One modified embodiment of the desired or nominal value generation for the closed-loop control is shown in FIG. 5. To generate a desired or nominal value, a desired or nominal value transmitter 80 having two inputs is supplied both with actual values of the rotational angle of the gear 35 by the rotary encoder 38, and actual values of the rotational angle of gears 26, 27, 28, 36, 37 from the other printing unit groups B and C. By way of example, the use of the signal from the rotary encoder 40 is illustrated in FIG. 5.

Figure 6:
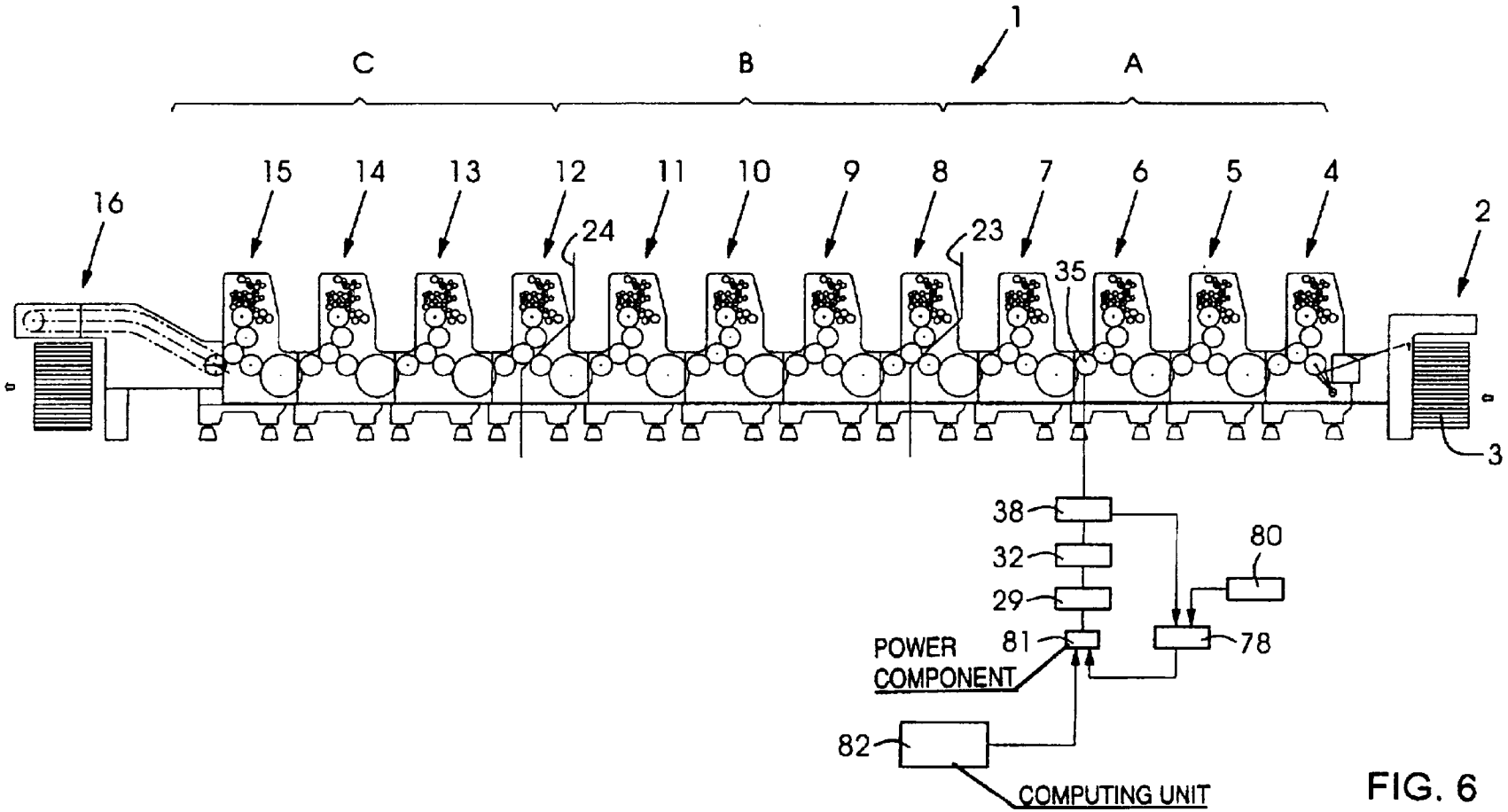
FIG. 6 is a view like that of FIG. 3 showing a control schematic for a printing unit group of a printing press according to FIG. 3.

FIG. 6 shows a modified embodiment of the closed-loop control of a main motor 29 with additional disturbance or interfering variable imposition or control. The power component 81 serving for supplying power to the main motor 29 has two inputs. One input serves for feeding a control variable thereto, as is generated in a manner equivalent for the modified embodiment shown in FIG. 4. Via the second input, an interfering variable, which is determined in a computing unit 82, is fed to the power component 81. The desired or nominal current value to be used in the power component 81 is preferably the sum or difference of these inputs. The determination of the interfering variable to be fed forward can be carried out in accordance with a method described in the Published German Patent Document DE 101 49 525 A1.

Figure 7:
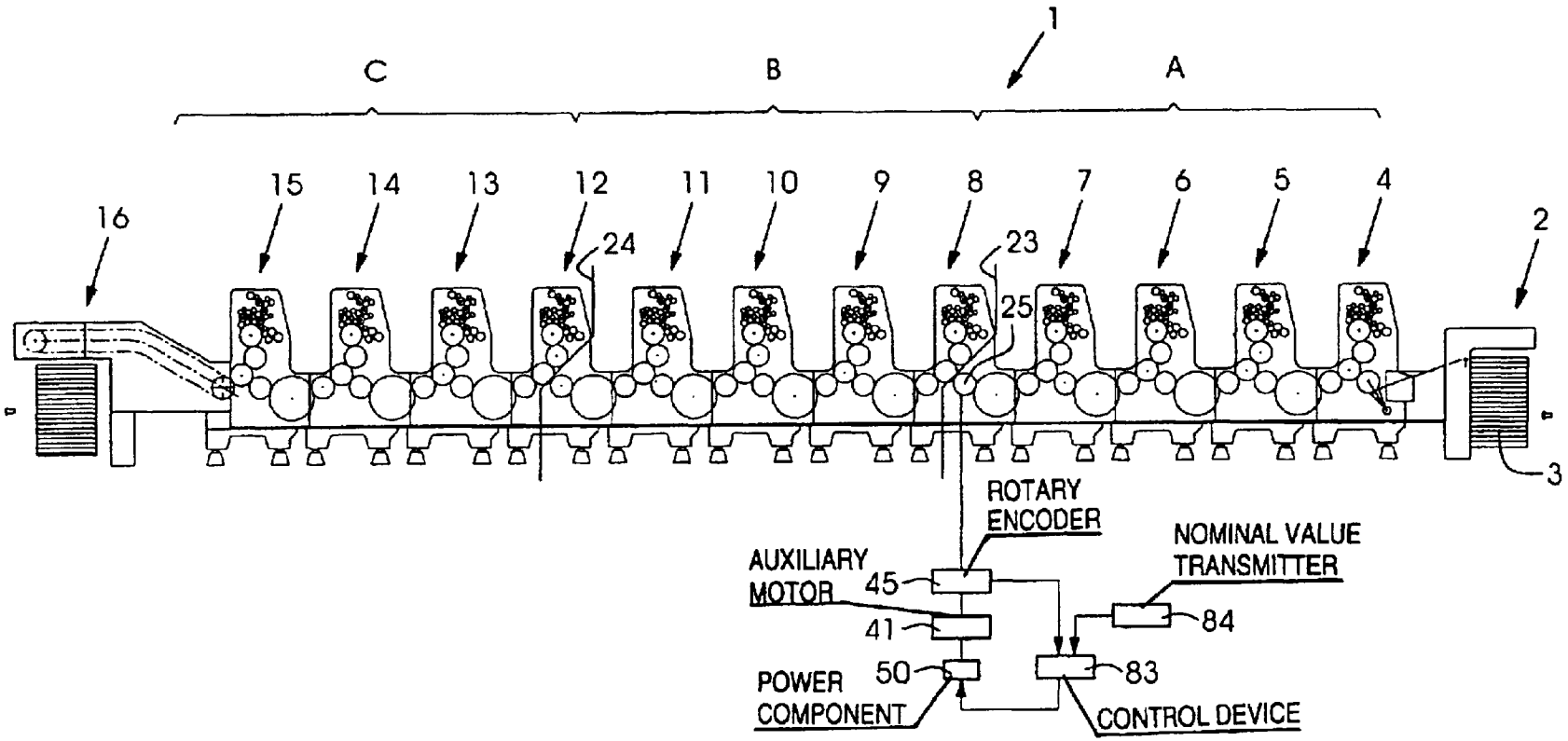
FIG. 7 is a view like that of FIG. 1 showing a control schematic for one of the auxiliary motors of the printing press according to FIG. 1.

In a manner similar to that described in relation to FIG. 4, closed-loop control of an auxiliary motor 41 can be carried out, as illustrated in FIG. 7. The rotary encoder 45 provides the actual value of the rotational angle of the gear 25 at the separation or disconnecting location 23. This actual value is fed to a control device 83, where it is compared with a desired or nominal value for the rotational angle from a desired or nominal value transmitter 84. The desired or nominal value for the auxiliary motor 41 differs from the desired or nominal value for the main motor 29 of the same printing unit group A, as is described further hereinafter with regard to FIGS. 10 and 11.

Figure 8:
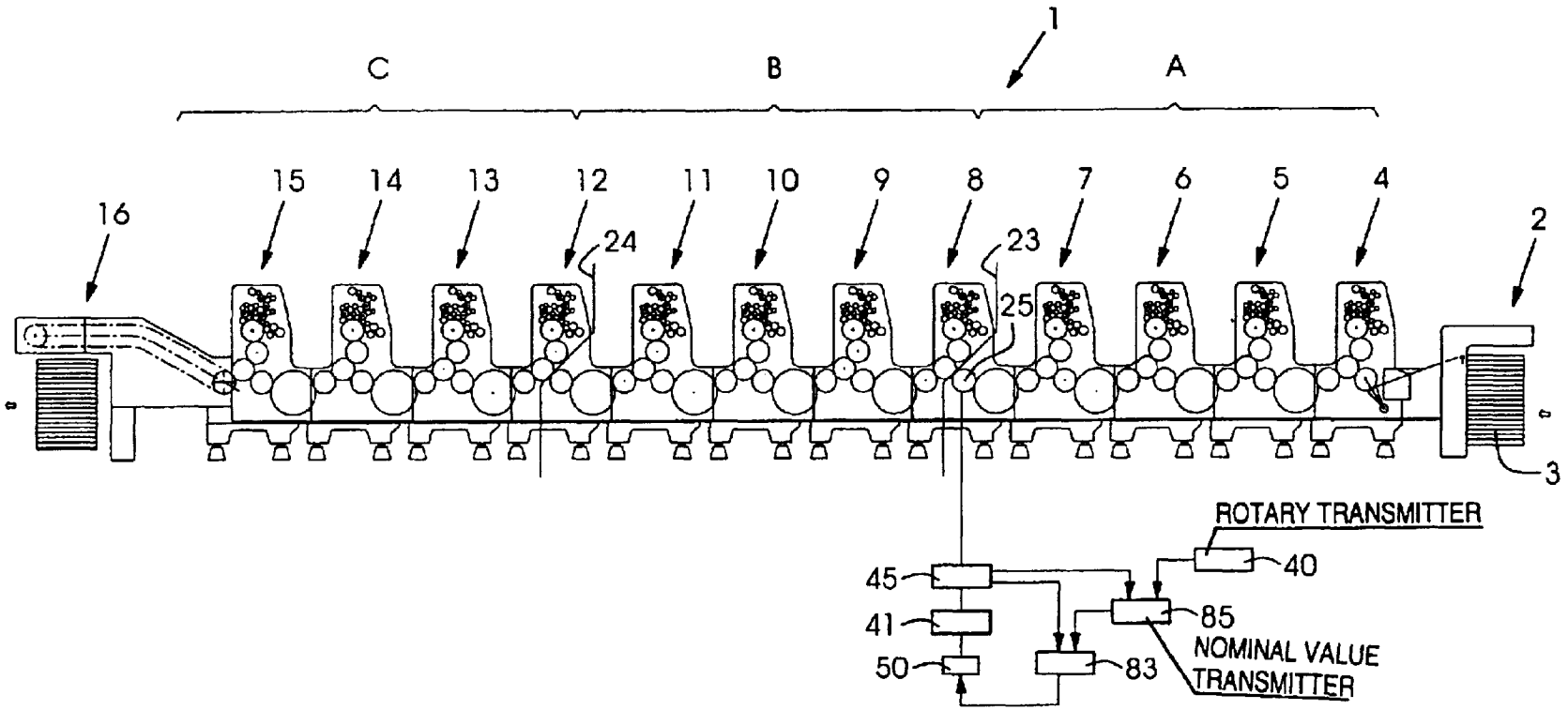
FIG. 8 is a view like that of FIG. 2 showing a control schematic for one of the auxiliary motors of the printing press according to FIG. 2.

FIG. 8 shows the procedure in the closed-loop control of an auxiliary motor 45, the desired or nominal value being determined from two different actual value signals in a way analogous to that of FIG. 5. A desired or nominal value transmitter 85 processes actual value signals relating to the rotational angle of the gear 25, these actual value signals originating from the rotary encoder 45, and actual value signals relating to the rotational angle of a gear 37 from a different printing unit group B or C.

Figure 9:
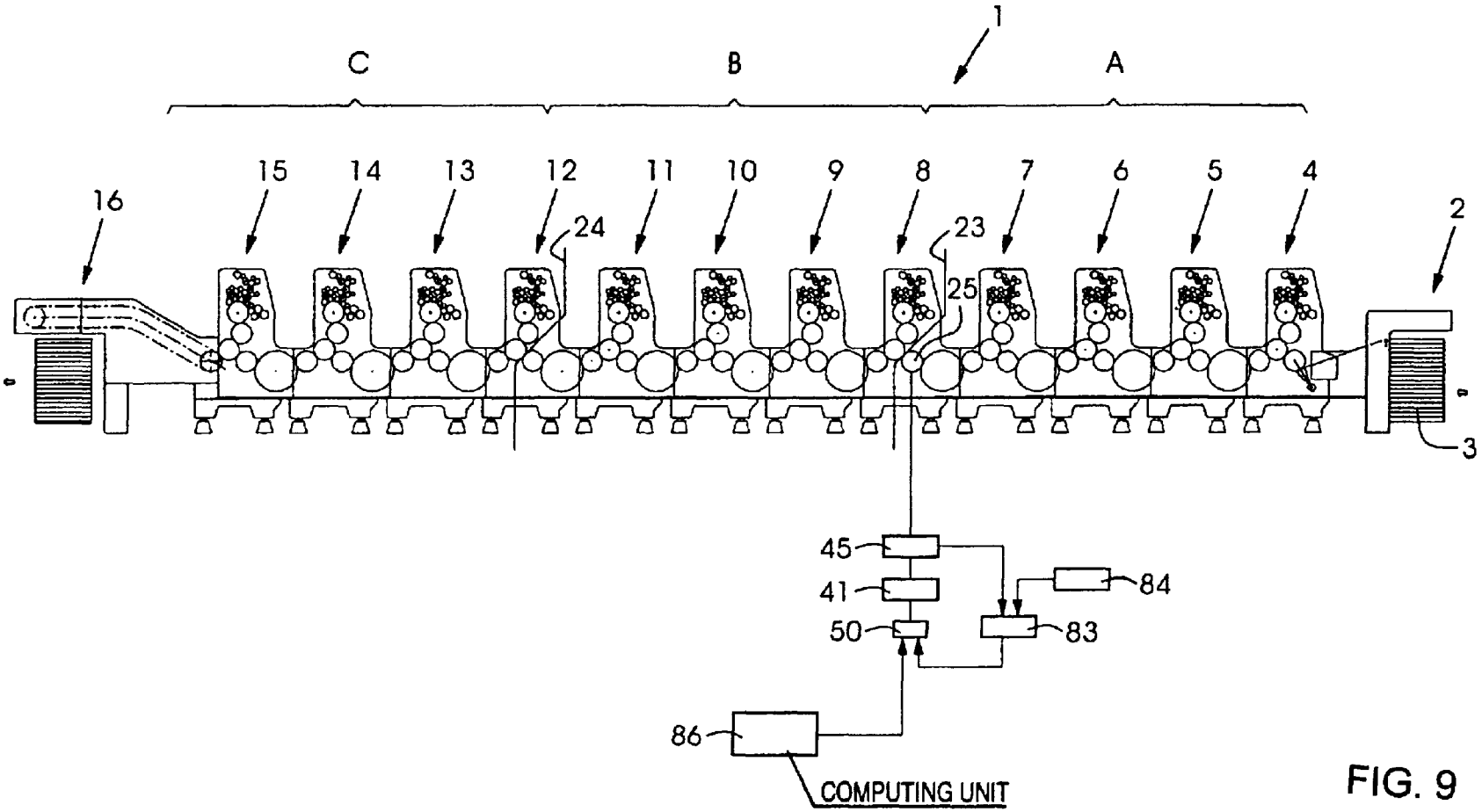
FIG. 9 is a view like that of FIG. 3 showing a control schematic for one of the auxiliary motors of the printing press according to FIG. 3.

FIG. 9 illustrates interference variable or feedforward control similar to that of FIG. 6 for the closed-loop control of an auxiliary motor 41. As already explained hereinbefore in relation to FIG. 6, the interfering variable to be fed forward is determined by a computing unit 86.

Figure 10:
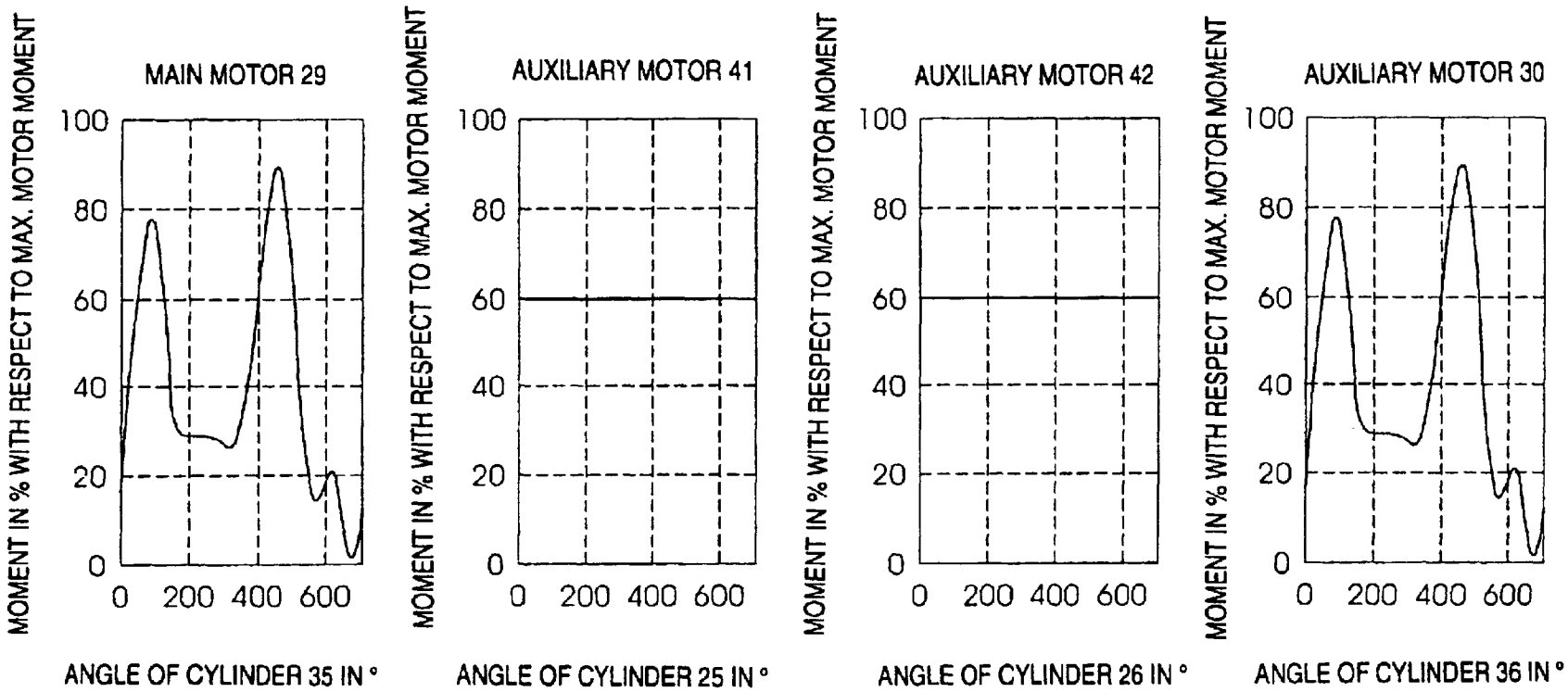
FIG. 10 is a series of graphs relating to the application of constant current to the auxiliary motors in the drive of a printing unit group according to FIG. 1.
Figure 11:
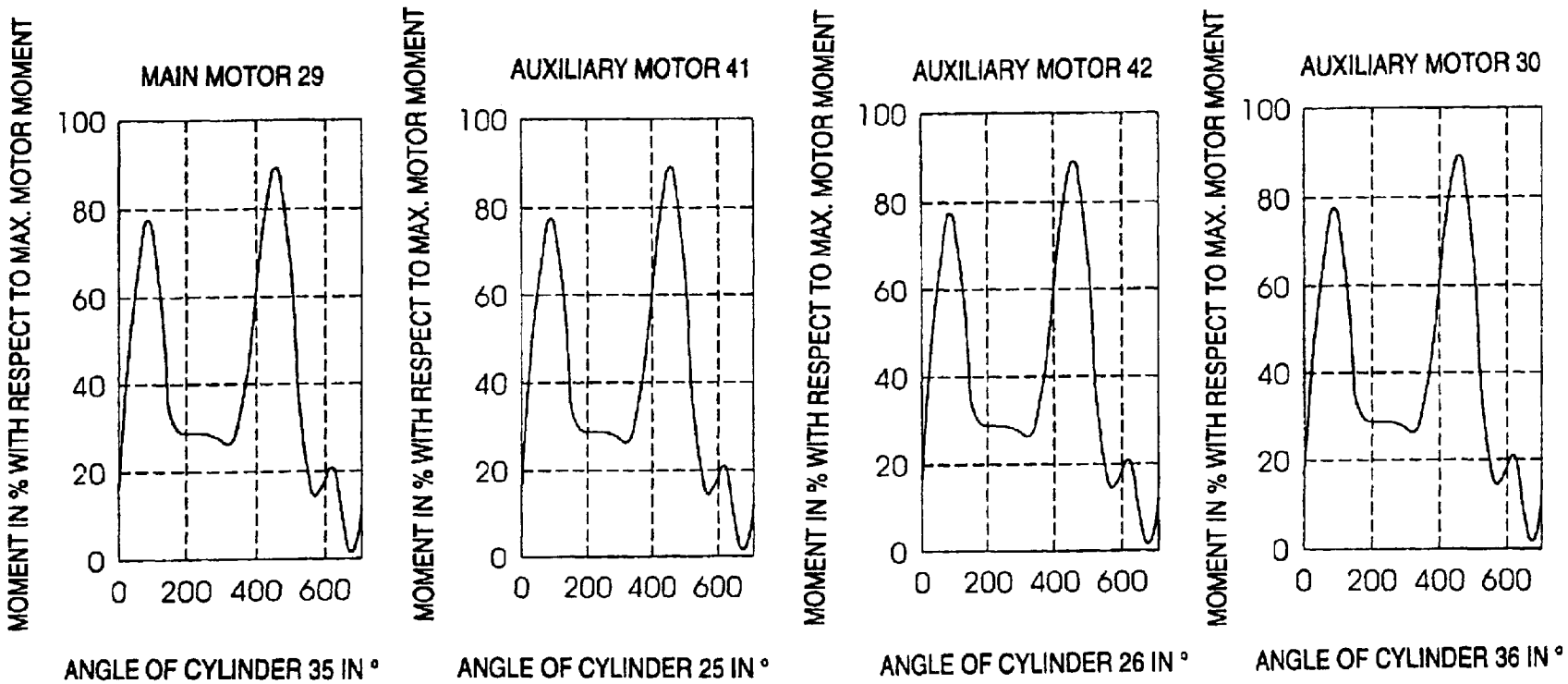
FIG. 11 is a series of graphs like those of FIG. 10 relating to the application of differential angles to the auxiliary motors in the drive of the printing unit group according to FIG. 1.

FIGS. 10 and 11 are graphs relating to the torque variation on the cylinders 35, 25, 26 and 36, respectively, which are produced by the main motors 29 and 30 and the auxiliary motors 41 and 42, as the case may be, in a sheet-fed printing press according to FIG. 1.

FIG. 10 indicates the application of constant current to the auxiliary motors 41 and 42, while the main motors 29 and 30 are feeding in a driving torque corresponding to the power demand. The application of constant current to the auxiliary motors 41 and 42 produces a braking torque, and flank changes are prevented on the gears of the printing unit groups A and B. The torques of the main motors 29 and 30 are controlled, the respective rotary encoders 38 and 39 supplying the actual values for the rotational angle at the cylinders 35 and 36, respectively.

FIG. 11 shows the application of a differential angle to the main motors 29 as compared with the auxiliary motors 41 and 42. In this modified embodiment, both the main motors 29, 30 and the auxiliary motors 41, 42 are operated with closed-loop control. The auxiliary motors 41, 42 are coupled to a rotary encoder 45, 46, which registers the rotational angle, the speed or the acceleration of the gears 25, 26. In general, it is true that the rotary encoders 45, 46 or other measuring sensors are arranged as close as possible to a separation location 23, 24, ideally on the paper-carrying elements immediately adjacent to a respective separation location 23, 24, here on the respective cylinders 25, 26 and 27, 28. The desired or nominal values are predefined or prescribed in relation to the separation location 23 for the closed-loop control of the torques of the main motors 29, 30 and of the auxiliary motors 41, 42 in such a way that flank changes in the gear trains are avoided. The main motors 29, 30 are therefore operated in relation to the auxiliary motors 41, 42 with a differential angle $(\alpha_1-\alpha_2)$, $(\alpha_3-\alpha_4)$, with $\alpha_2>\alpha_1$ and $\alpha_4>\alpha_3$, it being noted that $\alpha_1$ to $\alpha_4$ are the desired angular positions of the cylinders 35, 25; 26, 36 relative to a printing-press angle to be selected freely. The result is an offset in the gear train of the respective printing unit group A or B. The differential angle $(\alpha_1-\alpha_2)$, $(\alpha_3-\alpha_4)$ is selected so that the average motor current always has a maximum negative value which, when a constant desired or nominal current value is predefined or prescribed, actually avoids flank changes in the respective gear train of a printing unit group A or B, respectively. The same results occur functionally for the separation location 23.

It is also possible to vary the differential angles $(\alpha_1-\alpha_2)$, $(\alpha_3-\alpha_4)$ with the aid of a control loop so that a specific average auxiliary motor current is established.

At each separation location, the differential angle between the desired or nominal angular positions of the adjacent motors must be constant, preferably close to zero. For a plurality of separation locations in a printing press, the desired angular position of the last or first cylinder of a printing unit group is preferably predefined or prescribed or, with the aforedescribed auxiliary-motor desired or nominal current value control, calculated so that the auxiliary motor maintains a set average current value, while the desired or nominal angular position of the adjacent first or last cylinder of an adjacent printing unit group agrees directly with this desired or nominal angular position. The desired or nominal angular position for one end of a printing unit group is preferably taken over in this way from an adjacent printing unit group, while the desired or nominal angular position for the other end is calculated as an adjusted variable of the auxiliary-motor desired or nominal current value control described hereinabove and is transferred to the other adjacent printing unit group.

In the embodiment according to FIG. 1, if the desired or nominal value for the printing-press angle $\phi_{Ref}$ represents a primary desired or nominal value for the entire press, then, for example, the following desired or nominal values result: the desired or nominal value $\phi_{Ref,44}$ of the auxiliary motor 44 is equal to $\phi_{Ref}$, the desired or nominal value $\phi_{Ref,43}$ of the auxiliary motor 43 is equal to $\phi_{Ref,44}$. The desired value of the main motor 31 $\phi_{Ref,31}$ differs from $\phi_{Ref}$ by a differential angle $\Delta\phi_{31}$, i.e., $\phi_{Ref,31}=\phi_{Ref,44}+\Delta\phi_{31}$. The differential angle $\Delta\phi_{31}$ is set with the aid of the auxiliary-motor desired or nominal current value control described hereinabove so that the average desired or nominal value of the current of the auxiliary motor 44 has a desired value. The differential angle $\Delta\phi_{30}$ between the main motor 30 and the auxiliary motor 43, and the desired or nominal value of the main motor 30 $\phi_{Ref,30}$ are set in a corresponding way, i.e., in particular, $\phi_{Ref,30}=\phi_{Ref,43}+\Delta\phi_{30}$. The desired or nominal value of the auxiliary motor 42 $\phi_{Ref,42}$ differs from $\phi_{Ref,30}$ or $\phi_{Ref,43}$ by a differential angle $\Delta\phi_{42}$ which, for example, can be predefined or prescribed or, by the auxiliary-motor desired or nominal current value control described hereinabove, can be set so that the average desired or nominal value of the current of the auxiliary motor 42 has a desired value. This can be implemented, for example, by $\phi_{Ref,42}=\phi_{Ref,30}+\Delta\phi_{42}$ or $\phi_{Ref,42}=\phi_{Ref,43}+\Delta\phi_{42}$. The desired or nominal value of the following auxiliary motor 41 can then take over the desired or nominal value from the auxiliary motor 42, in the same way as the auxiliary motor 43 took over the desired or nominal value from the auxiliary motor 44. This algorithm may be continued to any desired number of separation locations. It is also unimportant as to at which location in the printing press the desired or nominal value of one or more motors is exactly equal to $\phi_{Ref}$.

The encoders associated with the main and auxiliary motors for rotational angle, speed or acceleration can be constructed as absolute-value encoders or incremental encoders. When incremental encoders with an index track are used, a start-up routine of a position control system can be carried out so that, following the first finding of an index pulse, desired or nominal and actual values are initially set equal and then the desired or nominal value for the respective motor is led to the desired or nominal value actually wanted via a continuous ramp.

We claim:

1. In a printing press having printing units disposed in a plurality of printing unit groups including at least one of the printing units, a multi-motor drive, comprising: a plurality of separate gear trains each synchronously driving a respective one of the printing unit group, said gear trains being mechanically separated from one a other during a printing operation at separation locations and at least one motor connected to each respective one of the printing unit groups at a respective one of said separation locations.

2. The multi-motor drive according to claim 1, wherein said at least one motor includes a main motor feeding into a respective gear train of a printing unit group and two auxiliary motors, for a respective one of the separation locations.

3. The multi-motor drive according to claim 1, wherein said at least one motor include a main motor feeding into a respective gear train of a printing unit group and only one auxiliary motor, for a respective one of said separation locations.

4. The multi-motor drive according to claim 1, wherein said at least one motor includes a main motor feeding into a respective gear train of a printing unit group and an auxiliary motor for a printing unit group located between two other printing unit groups, said auxiliary motor being assigned to one of the separation locations.

5. The multi-motor drive according to claim 2, wherein said auxiliary motors have a lower power than said main motors.

6. A method for driving printing press having printing units disposed in a plurality of printing unit groups each including at least one of the printing units, which comprises providing a plurality of mutually mechanically decoupled gear trains each synchronously driving a respective one of the printing unit groups, infeeding torques into each of the plurality of mutually mechanically decoupled gear trains of the printing unit groups at respective separation locations between the gear trains of the printing unit groups, for printing with a plurality of motors.

7. The method according to claim 6, which further comprises providing at least one main motor and at least one auxiliary motor for driving at least one gear train.

8. The method according to claim 7, which further comprises infeeding a torque for driving, on average, with the main motor, and producing a torque for braking, on average, with the auxiliary motor.

9. The method according to claim 7, which further comprises applying a constant nominal current value to the auxiliary motor.

10. The method according to claim 7, which further comprises controlling the main motor and the auxiliary motor with respect to a rotational angle thereof.

11. The method according to claim 10, which further comprise, setting an angular offset between the main motor and the auxiliary motor.

12. The method according to claim 10, which further comprises setting a constant angular offset between the main motor and the auxiliary motor.

13. The method according to claim 10, which further comprises variably setting a differential angle between the main motor and the auxiliary motor with a control system, for maintaining a nominal value of respective average actual current values of the auxiliary motors.

14. The method according to claim 7, which further comprises providing respectively constant differential angles of nominal values of a closed-loop control of at least one of the auxiliary and main motors on both sides of the separation location relative to a reference press angle, in a press with a plurality of separation locations, and determining the differential angle of the nominal value of the closed-loop control of a respective motor at a separation location of a printing unit group by an adjacent printing unit group.

15. The method according to claim 7, which further comprises providing respectively constant, lose to zero, differential angles of nominal values of a closed-loop control of at least one of the auxiliary and main motors on both aides of the separation location relative to a reference press angle, in a press with a plurality of separation locations, and determining the differential angle of the nominal value of the closed-loop control of a respective motor at a separation location of a printing unit group by an adjacent printing unit group.

16. The method according to claim 7, which further comprises performing an interference variable control when driving at least one of the main and auxiliary motors.

* * * * *

UNITED STATES PATENT AND TRADEMARK OFFICE

CERTIFICATE OF CORRECTION

PATENT NO. : 6,823,792 B2
DATED : November 30, 2004
INVENTOR(S) : Bertold Grützmacher et al.

It is certified that error appears in the above-identified patent and that said Letters Patent is hereby corrected as shown below:

Column 9,
Lines 5-6, claim 1 should read as follows:
one of the printing unit groups, said gear trains being
mechanically separated from one another during a printing
Line 17, claim 3 should read as follows:
said at least one motor includes a main motor feeding into a
Line 30, claim 6 should read as follows:
6. A method for driving a printing press having printing Column 10,
Line 10, claim 11 should read as follows:
comprises, setting an angular offset between the main motor
Line 30, claim l5 should read as follows:
comprises providing respectively constant, close to zero,
Line 32, claim l5 should read as follows:
of at least one of the auxiliary and main motors on both sides Signed and Sealed this Twenty-second Day of March, 2005

JON W. DUDAS
*Director of the United States Patent and Trademark Office*